US008366511B2

(12) United States Patent
Morello

(10) Patent No.: US 8,366,511 B2
(45) **Date of Patent: *Feb. 5, 2013**

(54) GARMENT SUPPORTING APPARATUS

(76) Inventor: Lucy Morello, Windlesham (GB)

( * ) Notice: Subject to any disclaimer, the term of this patent is extended or adjusted under 35 U.S.C. 154(b) by 925 days.

This patent is subject to a terminal disclaimer.

(21) Appl. No.: 12/224,158

(22) PCT Filed: Aug. 21, 2007

(86) PCT No.: PCT/EP2007/007356

§ 371 (c)(1),
(2), (4) Date: Aug. 20, 2008

(87) PCT Pub. No.: WO2008/022768

PCT Pub. Date: Feb. 28, 2008

(65) Prior Publication Data

US 2009/0047867 A1 Feb. 19, 2009

(30) Foreign Application Priority Data

Aug. 22, 2006 (GB) ..... 0616635.9

(51) Int. Cl.
*A41C 3/00* (2006.01)

(52) U.S. Cl. ..... 450/86; 450/88; 2/326

(58) Field of Classification Search ..... 450/86, 450/88; 2/336, 338, 310, 311, 312, 326, 2/327, 309; 24/98, 200, 308, 600.9, 601.2, 24/601.3, 601.4

See application file for complete search history.

(56) References Cited

U.S. PATENT DOCUMENTS

| | | | | | |
|---|---|---|---|---|---|
| 1,780,931 | A * | 11/1930 | Konigsberger | 24/316 |
| 2,689,348 | A * | 9/1954 | Crawford | 2/460 |
| 2,849,723 | A * | 9/1958 | Marino | 2/323 |
| 3,077,650 | A * | 2/1963 | Horne | 24/200 |
| 3,209,370 | A * | 10/1965 | Miller | 2/232 |
| 6,086,451 | A * | 7/2000 | Fernandes | 450/86 |
| 6,715,186 | B1 * | 4/2004 | Huang | 24/299 |
| 6,857,936 | B2 * | 2/2005 | Jones et al. | 450/86 |
| 7,833,085 | B2 * | 11/2010 | Crouch | 450/86 |
| 2003/0003844 | A1 * | 1/2003 | Jones et al. | 450/88 |

FOREIGN PATENT DOCUMENTS

GB 2419801 * 5/2006

* cited by examiner

*Primary Examiner* — Gloria Hale

(57) ABSTRACT

Garment supporting apparatus for a breast covering garment, comprising a flexible strap and a decorative attachment member.

20 Claims, 2 Drawing Sheets

Fig 7
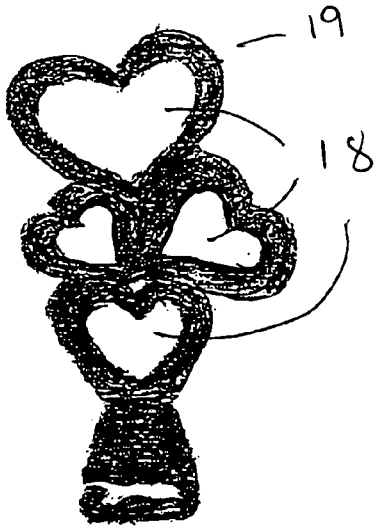
Fig 8
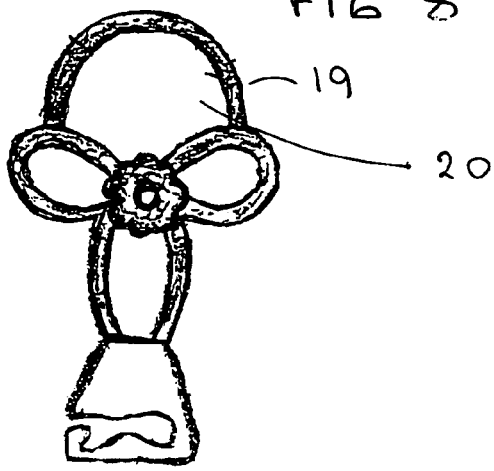
Fig 10
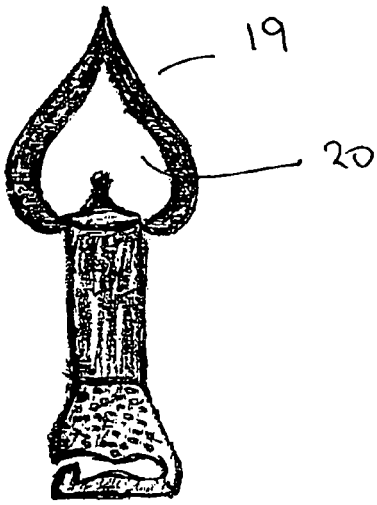
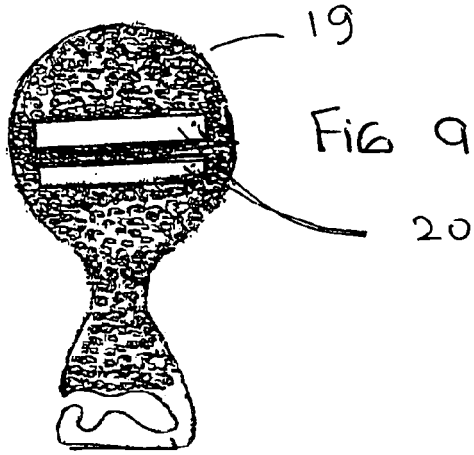
Fig 9

GARMENT SUPPORTING APPARATUS

The present invention relates to a combination of jewelry, clothing accessories, brassieres, brassiere strap replacements and fasteners, where a fastener doubles as a fixing and decorative garment accessory, which attaches typically to a breast-covering garment or brassiere and acts as a connector between said brassiere and a second clothing accessory, which attaches to a body of a wearer, to hold said breast-covering garment in the desired position.

TECHNICAL FIELD

Typically brassieres come with fixed or detachable straps (a bra with detached strap is commonly known as strapless). These straps generally have a functional appearance only. FIG. 1 a 'strapless' bra (1) generally provides loops (2) for the attachment of straps, positioned near the upper edge of the bra. FIG. 2 shows a hook generally used to attach straps to bras. Many women find it difficult to get by with wearing a strapless bra, as it does not offer enough support. Because most straps are unsightly women find there are fashionable items they cannot wear i.e. strappy camisoles or strapless dresses.

Bra straps may have decorations fixed to them or decorative covers placed over them in an effort to make them more attractive, but generally they are unattractive and have purely a functional appearance and when visible lessen the overall aesthetical ensemble of a wearer. Transparent straps made of a rubberized plastic material snap easily and offer minimal amount of support.

BACKGROUND ART

WO2004010814 makes an attempt to a solution by replacing conventional straps with decorative chains. These have proved unsuitable and unsafe for women with large breasts as they dig into the skin.

GB 241.9801

Inventor: Wilkinson Leena

Seeks to decorate an existing strap by placing decorative elements in it, but this still leaves the problem that part of the strap is visible and at best the cover creates the appearance of bulk

US2003/0003844A1

Inventor: Jones Wendy

Invention relates to a minimalist breast-covering garment. This garment comprises or a piece of fabric with a plurality of fabric loops or slits distributed around its edges and uses a considerable amount of customary connectors of the like typically used in dressmaking i.e.: hooks and eyes, snaps, buttons, etc. This type of design is decorative but doesn't offer any breast support to the wearer.

JP 2006 104610 A

Inventor: Gunze K K

Presents various accessories, which attach to a brassiere itself and to the straps of a brassiere in order to embellish them. It appears that it leaves the original strap partially visible.

JP 2004 183146 A

Inventor: Yoshida Kazuhiro

Presents a connector device with which two separate straps may be joined together to show a decorative item above shoulder.

U.S. Pat. No. 6,086,451A (Frenandes Marcia); U.S. Pat. No. 6,715,186B1 (Huang Pei-Hui); EP1378184A (Wang Wen-Da); US2004/020240 A1 (Brancato Theresa); US2003/209034A1 (Huang Pei-Hui)

These inventions relate to various decorated chains and/or transparent straps used to replace a brassiere's straps.

JP2001003214A

Inventor Utax K K

Refers to a hidden connector used to change the angle or a brassiere's straps.

SUMMARY OF THE INVENTION

The present invention replaces the conventional strap altogether with a more attractive, safe and comfortable ensemble which makes use of a portion of material, shaped as a narrow scarf or sash, which may be cotton, silk or any preferred material, to support the breast-covering garment.

According to the present invention there is provided a connector with two fixing ends, which fastens to a breast-covering garment on one end and to a second garment accessory on the opposite end, said garment accessory replaces the bra straps and holds said breast-covering garment in the desired position in the body of the wearer. Said connector may be plain or embellished as an item of costume or real jewelry, using stones, crystals, diamantes, beads or any decorations well known in the costume jewelry/jewelry and accessories sector.

The current invention provides a novel, attractive and comfortable alternative to traditional bra straps and overcomes the problems associated with prior art Said connector may be attached to the bra or detachable and re-attachable and/or inter-changeable. It fastens to a bra or other breast-covering garment and is used in conjunction with a second garment accessory, which acts as a supporting element, generally in the form of a narrow scarf, decorated or plain, which threads through said connector to hold breast-covering garment securely and comfortably in the desired position and orientation in the body of wearer.

The fastener/connector relating to this invention is constructed to incorporate the following in its design:

1. —A fixing element, which fastens to the breast-covering garment by various methods, which may include, but not exclusively, hooks, clasps, springs, snap, hooks, sewing, Velcro.
2. —A supporting section presenting an aperture to permit the insertion of a portion of material, textile or other, which will support the breast-covering garment and connector in place by tying to body of wearer;
3. —An optional decorative element.

It is envisaged that the item relating to this invention may be constructed as a solid piece or it may be an ensemble comprising of a series of sections joined together by connecting links in which case it is desired that the individual members of this decorative connector can move one relative to another to allow for movement ie: pivoting, swivelling, rotating and/or inter-changing of sections.

BRIEF DESCRIPTIONS OF DRAWINGS

FIG. 1

Prior Art

Shows a strapless bra and indicates the approximate location for inner strap attachment loops.

FIG. 2

Prior Art

Commonly known bra straps' attachment hook.

FIG. 3

An illustration of the present invention.

FIG. 4

Prior Art

Illustrates a spring clasp.

FIG. 5

Illustrates a method for assembling the present invention.

FIG. 6

Illustrates a view of the present invention as worn in preferred halter-neck manner.

FIG. 3 illustrates an ornamental embodiment of the invention, constructed in metal alloy as customarily used in the art of fashion jewelry, where (10) is a hook presenting a horizontal bar, which inserts through a loop provided by a strapless bra, (8) is the ornamental section, decorated with colour enamel and crystal/stones, (7) is the supporting section, also decorated, which presents the desired aperture (6) which permits the insertion of a supporting element in the shape of a scarf and (9) illustrates a connective link or clasp, which allows movement for comfort and orientation.

As an alternative to a hook as illustrated in FIG. 3, said decorative connector may make use of a clasp, like the one illustrated in FIG. 4.

FIG. 5 illustrates an arrangement not according the invention, where (1) a strapless bra, where a decorative 110 connector of annular shape (14,16) is sewn into the garment, used in conjunction with a narrow scarf (13,17) with fringe decorations in it (12,15), providing all sections comprised into one single piece. A preferred method of attachment of this embodiment is described below:

An individual wearing a strapless bra a) Positions the sash/scarf over the neck b) Threads each end of the sash individually through the aperture provided by the annular piece sewn into the bra c) Secures both ends of the scarf together behind the neck, creating strong and comfortable support.

FIG. 6 provides an illustration of a more intricate arrangement, similar to the one illustrated in FIG. 3, where the decorative connector comprises of more than one sections linked together.

FIG. 7, FIG. 8 and FIG. 9 illustrates one-piece connectors presenting various apertures for insertion of the supporting scarf.

FIG. 10 illustrates a connector presenting a perfume holder with a screw on top, aperture for insertion of scarf and hook for attaching to breast garment.

Figure 1:
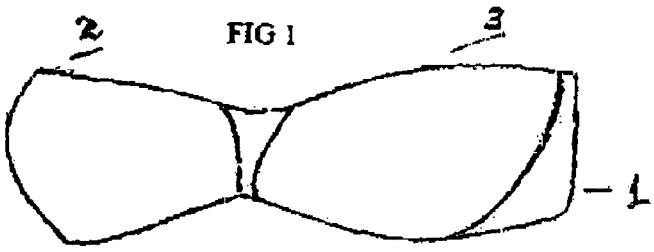
Prior art FIG 1
Figure 2:
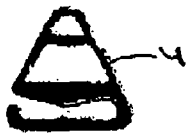
FIG 2 Prior art
Figure 3:
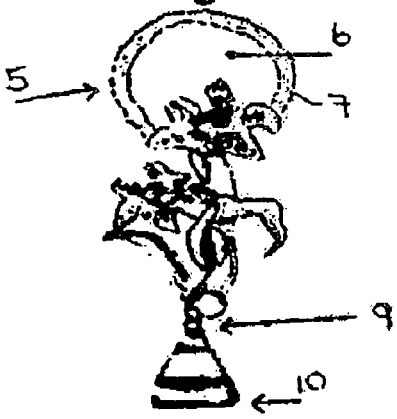
Figure 4:
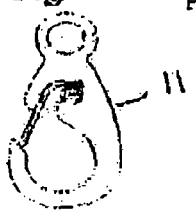
Fig 4 Prior art
Figure 6:
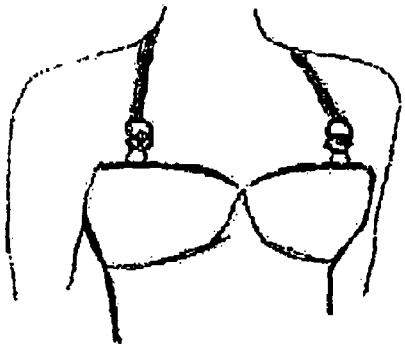
Figure 5:
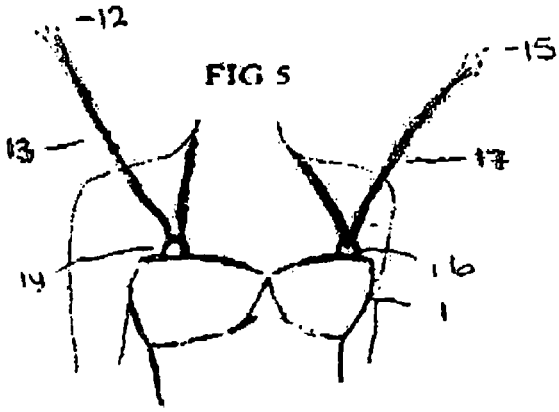

There are no limitations for the level of decoration and creativity associated with this novel accessory as its functionality combines with the field of jewelry design and this description is limited, for obvious reasons, to preferred embodiments. Size is variable and determined by fashion, taste, style, finances or other, but preferred length would be 1.5 to 6 inches (3.81 cm×15.24 cm) long and preferred width would be half an inch to 2 inches (1.27 cm×5.08 cm) wide. Constructed in various materials preferably ones which allow safety and comfort like many of the alloy metals used in fashion jewelry, also the use of precious or semi-precious and decorative stones and crystals is desired, as are magnetic materials with health benefits and medicinal uses and perfume carriers.

The invention claimed is:

1. A garment supporting apparatus for supporting a breast covering garment comprising:

a decorative connector member adapted to connect a breast covering garment with a flexible support strap, and a flexible support strap in the form of a fabric member;

said decorative connector member having dimensions that extend from approximately two inches to five inches long by one inch to two inches wide and comprising a series of sections joined together by connecting links;

said series of sections are structured to move one relative to another to allow for the rotating of said sections relative to each other;

said decorative connector member having a first fixing end and a second opposing fixing end;

said first fixing end has an attachment means for releasable attachment to a sewn garment loop near an upper edge of said breast covering garment;

said second fixing end of said decorative connector member is a connector loop;

said fabric member of said garment supporting apparatus releasably threads through said connector loop therein;

said fabric member is of a length suitable to surround a neck of a wearer of said breast covering garment to thereby support said breast covering garment in a desired position and orientation on the body of the wearer of said breast covering garment.

2. The garment supporting apparatus as claimed in claim 1 wherein said first fixing end of said decorative connector member includes an attachment means in the form of any one of a brassiere hook with a lower horizontal bar, a clasp or a spring clip.

3. The garment supporting apparatus as claimed in claim 1 wherein said decorative connector member is decorated with any one of or a mixture of rhinestones, crystals, beads, precious or semi-precious stones.

4. The garment supporting apparatus as claimed in claim 1 wherein said fabric member is a sash.

5. The garment supporting apparatus as claimed in claim 2 wherein said decorative connector member is decorated with any one of or mixture of rhinestones, crystals, beads, precious or semi-precious stones.

6. The garment support apparatus as claimed in claim 3 wherein said fabric member is a sash.

7. The garment support apparatus as claimed in claim 5 wherein said fabric member is a sash.

8. The garment support apparatus as claimed in claim 2 wherein said fabric member is a sash.

9. A garment supporting apparatus for supporting a breast covering garment comprising:

a decorative connector member with no moveable parts therein adapted to connect a breast covering garment with a flexible support strap;

a flexible strap in the form of a fabric member;

said decorative connector member having dimensions that extend from approximately two inches to five inches long by one inch to two inches wide and having a first and second opposing fixing ends;

said fixing end has an attachment means for releasably attaching to a loop sewn near an upper edge of a breast covering garment worn therewith;

said second fixing end of said decorative connector member is a loop;

said fabric member is of a length suitable to surround a neck of a wearer of said breast covering garment to thereby support said breast covering garment in a desired position and orientation on the body of the wearer.

10. The garment supporting apparatus as claimed in claim 9 wherein said first fixing end of said decorative connector member includes an attachment means in the form of any one of a brassiere hook with a lower horizontal bar, a clasp or a spring clip.

11. The garment supporting apparatus as claimed in claim 9 wherein said decorative connector member is decorated with any one of or a mixture of rhinestones, crystals, beads, precious or semi-precious stones.

12. The garment supporting apparatus as claimed in claim 9 wherein said fabric member is a sash.

13. The garment supporting apparatus as claimed in claim 10 wherein said decorative connector member is decorated with any one of or mixture of rhinestones, crystals, beads, precious or semi-precious stones.

14. The garment support apparatus as claimed in claim 11 wherein said fabric member is a sash.

15. The garment support apparatus as claimed in claim 13 wherein said fabric member is a sash.

16. The garment support apparatus as claimed in claim 10 wherein said fabric member is a sash.

17. A strapless torso covering garment in combination with a garment support apparatus As claimed in claim 1 above and further comprising:

said strap less torso covering garment having an upper edge wherein fabric loops are attached along said upper edge;

said fabric straps of said garment supporting apparatus is thereby attached therethrough said loops and looped about the neck of the wearer in use.

18. A strapless torso covering garment in combination with a garment support apparatus as claimed in claim 9 above and further comprising:

said strap less torso covering garment having an upper edge wherein fabric loops are attached along said upper edge;

said fabric straps of said garment supporting apparatus is thereby attached therethrough said loops and looped about the neck of a wearer in use.

19. A strapless torso covering garment in combination with a garment support apparatus as claimed in claim 2 above and further comprising:

said strapless torso covering garment having an upper edge wherein fabric loops are attached along said upper edge;

said fabric straps of said garment supporting apparatus is thereby attaché therethrough said loops and looped about the neck of a wearer in use.

20. A strapless torso covering garment in combination with a garment support apparatus as claimed in claim 10 above and further comprising:

said strapless torso covering garment having an upper edge wherein fabric loops are attached along said upper edge;

said fabric straps of said garment supporting apparatus is thereby attaché therethrough said loops and looped about the neck of a wearer in use.

* * * * *